US008905803B2

(12) United States Patent
Hobbs et al.

(10) Patent No.: US 8,905,803 B2
(45) Date of Patent: Dec. 9, 2014

(54) RESCUE DEVICE

(75) Inventors: Anthony James Patrick Hobbs, Berkshire (GB); David Allan Taylor, Hertfordshire (GB)

(73) Assignee: Fibrelight Developments Limited, Berkshire (GB)

( * ) Notice: Subject to any disclaimer, the term of this patent is extended or adjusted under 35 U.S.C. 154(b) by 849 days.

(21) Appl. No.: 12/669,084

(22) PCT Filed: Jul. 21, 2008

(86) PCT No.: PCT/GB2008/002505
§ 371 (c)(1),
(2), (4) Date: Apr. 22, 2010

(87) PCT Pub. No.: WO2009/010777
PCT Pub. Date: Jan. 22, 2009

(65) Prior Publication Data

US 2010/0203780 A1 Aug. 12, 2010

(30) Foreign Application Priority Data

Jul. 19, 2007 (GB) ..... 0714144.3

(51) Int. Cl.
*B63C 9/26* (2006.01)
*A61G 1/013* (2006.01)

(52) U.S. Cl.
CPC .. *A61G 1/013* (2013.01); *B63C 9/26* (2013.01)
USPC ..... 441/80; 441/83; 5/81.1 R; 182/138

(58) Field of Classification Search
USPC ..... 5/625, 81.1 R; 182/196, 138; 441/80, 83
See application file for complete search history.

(56) References Cited

U.S. PATENT DOCUMENTS 2,489,828 A 11/1949 Springer
2,985,154 A 5/1961 Mutchler
2,985,254 A 5/1961 Marryatt
(Continued)

FOREIGN PATENT DOCUMENTS

DE 3307227 9/1984
DE 19631672 2/1998
(Continued)

OTHER PUBLICATIONS

WS Atkins Consultants Ltd., "Rough weather rescue", Offshore Technology Report, 2001/089, 78 pages.
(Continued)

*Primary Examiner* — Peter M Cuomo
*Assistant Examiner* — Brittany Wilson
(74) *Attorney, Agent, or Firm* — Snell & Wilmer L.L.P.

(57) ABSTRACT

A device (1) for use in recovering a person who may be exhausted, injured or unconscious from the sea. The device (1) comprises a plurality of rigid rods (2) enclosed within a sheath (7) made from flexible tubular webbing. The sheath (7) comprises at least one flange (3) extending radially outwards from the rod (2). The device (1) also comprises a plurality of linking webbing elements (4) made from a flexible material. The linking webbing elements (4) are attached to the flange (3) of the sheaths (7) encasing the rods (2) to form a network of rods (2) enclosed within tubular webbing sheaths and linking webbing elements (4).

21 Claims, 5 Drawing Sheets

(56) References Cited

U.S. PATENT DOCUMENTS

| | | | | |
|---|---|---|---|---|
| 3,326,322 | A | 6/1967 | Buck, Jr. | |
| 3,912,138 | A * | 10/1975 | Pava | 224/154 |
| 5,228,535 | A | 7/1993 | McCarty | |
| 5,320,566 | A | 6/1994 | Low, Jr. | |

FOREIGN PATENT DOCUMENTS

| | | |
|---|---|---|
| GB | 1276666 | 6/1972 |
| GB | 2015632 | 9/1979 |
| GB | 2157574 | 10/1985 |
| GB | 2217268 | 10/1989 |
| GB | 2240748 | 8/1991 |
| GB | 2286622 | 8/1995 |
| GB | 2327096 | 1/1999 |
| WO | WO 99/66165 | 12/1999 |

OTHER PUBLICATIONS

The Int'l Search Report from corresponding International Application No. PCT/GB08/002505 dated Dec. 18, 2008.

* cited by examiner

RESCUE DEVICE

CROSS-REFERENCE TO RELATED APPLICATIONS

This application is U.S. national phase filing under 35 U.S.C. §371 of PCT/GB2008/002505 filed Jul. 21, 2008 and claims priority from United Kingdom Application No. GB 0714144.3 which was filed on Jul. 19, 2007, and are both incorporated herein by reference.

The present invention relates to a device comprising a network of rods and linking webbing elements such as can be used to support a person, e.g. for rescue. The invention also relates to the uses of the device.

A draft safety regulation requires all passenger-carrying vessels to have on board rescue equipment that is suitable for the recovery of a person in the water, for example, in a man-overboard situation.

There are several rescue devices currently used on vessels for the purpose of sea rescue and recovery. The simplest arrangement is a scramble net comprising a web of ropes. However, such an arrangement is difficult to deploy and use in practice. Furthermore, it is recognised that to minimise the risk of post-rescue collapse and heart failure caused by a sudden drop in blood pressure, a casualty recovered from the water should be maintained in a horizontal position.

One of the most commonly used pieces of rescue equipment is the "Jason's Cradle®", manufactured by Land and Marine Products (LMP). It enables a person who may be exhausted, injured or unconscious to be rescued from the sea by recovering the person in a horizontal position within the cradle. It can also be used as a scramble net or a stretcher. The Jason's Cradle® is made from sections of rigid plastic that are linked together with stainless steel rods to form a grid or network. Disadvantageously, the purchase and servicing of the cradle is expensive. Furthermore, the plastic cradle is bulky and takes up a large amount of storage space. This is especially inconvenient on a small rescue boat or inflatable craft.

Alternatively the "Dacon Rescue Frame" is also used for rescue and recovery. It is made from parallel glass fibre rods connected together by lengths of webbing which lie at right angles to the rods. The lengths of webbing are made from a flexible material, which is fastened to the rods using metal rivets.

Typically, such rescue devices are attached by an inboard end to one side of a boat or ship, the middle being lowered into the water using a bridle, rope, winch or boathook attached to the outboard end. An individual to be rescued is located in the rescue device in a horizontal position and the outboard end of the rescue device is then raised to bring the individual aboard.

Stretchers are also commonly used rescue devices. The Neil Robertson Stretcher, currently used by the Royal Navy and NATO, was devised in the early 1900's. It is manufactured using canvas and wooden battens. Unfortunately, the battens are susceptible to mildew and rot in damp conditions e.g. on-board a boat, and the canvas can be difficult to clean after use.

WO-A-99/66165 discloses a separate area of endeavour, namely lightweight climbing equipment (so-called "Fibre-light Ladders"). The ladder has carbon fibre rungs enclosed in a sheath made from a flexible material. Either end of each sheath is attached to perpendicular linking webbing elements using bar tack stitching, the linking webbing elements forming either side of the ladder. This type of device is not suitable for sea rescue equipment as it is not wide enough to support an injured or exhausted person being pulled out of the sea in a horizontal position.

The present invention seeks to alleviate some or all of these disadvantages of the rescue devices currently available.

According to one aspect of the present invention there is provided a device comprising a plurality of rigid rods each encased within a sheath made from flexible tubular webbing comprising at least one flange extending radially outwardly from the tubular webbing, and a plurality of linking webbing elements made from a flexible material; wherein the linking webbing elements are attached to the flange of the tubular webbing sheaths to form a network of rods encased within tubular webbing sheaths and linking webbing elements.

In particular, the device is for supporting a person.

It is preferred that the device of the present invention is for use in the rescue and recovery of a person who may be exhausted, injured or unconscious from the sea.

Preferably, the rigid rods are made from glass fibre.

Alternatively, the rigid rods are made from a composite material, metal or fibre, preferably carbon fibre.

Conveniently, the rigid rods are at least 100 cm, preferably 120 cm long.

Preferably, the linking webbing elements span a distance of between 1 m to 20 m, more preferably 3 m.

Conveniently, each linking webbing element is a continuous element extending between the two farthest rods.

Advantageously, the rigid rods are between 5 mm and 25 mm, preferably 8 mm, and most preferably 15 mm in diameter.

Preferably, the webbing is a synthetic fibre.

Conveniently, the webbing is polyester, preferably polyester weave.

Advantageously, the flange of the flexible tubular webbing is between 2.5 mm and 8 cm, preferably between 1 cm and 8 cm, and most preferably 2 cm wide.

Preferably, the sheath made from flexible webbing comprises two flanges extending radially outwardly from the rod.

Conveniently, the linking webbing elements are attached to the flange of the sheath of flexible webbing by sewing.

Advantageously, the sewing comprises a row of stitching that is continuous along the length of the flange.

Alternatively, the sewing comprises zig-zag stitching spanning the depth of the flange.

Alternatively, the flexible linking webbing elements are attached to the flange of the sheath of flexible webbing by welding.

Preferably, the rigid rods are arranged in parallel.

Conveniently, the flexible linking webbing elements are attached at right angles to the tubular webbing encasing the rigid rods.

Advantageously, the tubular webbing and flexible linking webbing elements are regularly spaced.

Preferably, the rigid rods are parallel to each other and are between 15 cm and 60 cm, preferably 30 cm, apart.

Conveniently, the flexible linking webbing elements are between 15 cm and 60 cm, preferably 30 cm apart.

Advantageously, at least one of the linking webbing elements comprises a loop at one end.

Alternatively, at least one of the linking webbing elements comprises a loop at both ends.

Preferably, at least one of the linking webbing elements comprises pockets at predetermined intervals, the rigid rods encased within the sheath being located within the pockets.

Conveniently, the device further comprises additional flexible webbing rungs parallel to the rigid rods.

Advantageously, the device further comprises a flotation device.

Conveniently, the rigid rods are made from different materials.

Preferably, the device comprises four or more rigid rods.

Preferably, the device comprises two or more linking webbing elements.

Conveniently, the device further comprises a mesh material that is located between at least two of the rigid rods.

Conveniently, the plurality of rigid rods and the plurality of linking webbing elements comprise a core of the device, and wherein the device further comprises additional panels on one or more sides of the core, the panels comprising a network of rigid rods encased within tubular webbing sheaths and linking webbing elements.

Preferably, the panels are attached to the core of the device by the linking webbing elements, which optionally span the device.

Conveniently, each panel further comprises additional linking webbing elements which are attached to the rigid rods of the panel but are not attached to the rigid rods of the core.

Advantageously, the rigid rods of at least one of the panels are parallel to the rigid rods of the core of the device.

Preferably, the rigid rods of at least one of the panels are positioned at an angle to the rigid rods of the core of the device.

According to another aspect of the present invention there is provided the use of a device of the invention as a rescue or recovery cradle, a scramble net, a stretcher, or a ladder.

Preferably, the device is a rescue device.

According to another aspect of the invention there is provided a vessel comprising the device of the present invention.

The device of the present invention can be light and manoeuvrable, so enabling one person to manage it alone. It is suitable for use in all vessels, and in particular it is ideal for use in small rescue boats because the construction allows it to be rolled up and stored in a small space. The device need not contain materials, such as metal, that can be corroded by salt water. The polyester weave that the device comprises can be durable, and withstand photo-degradation and degradation in sea water. This makes such devices less expensive to purchase and maintain compared with those currently available.

"Webbing" in this specification refers to a flexible material in the form of a flat strip or tube. The material may be a woven fabric.

Embodiments of the invention will now be described with reference to the accompanying figures in which.

Figure 1:
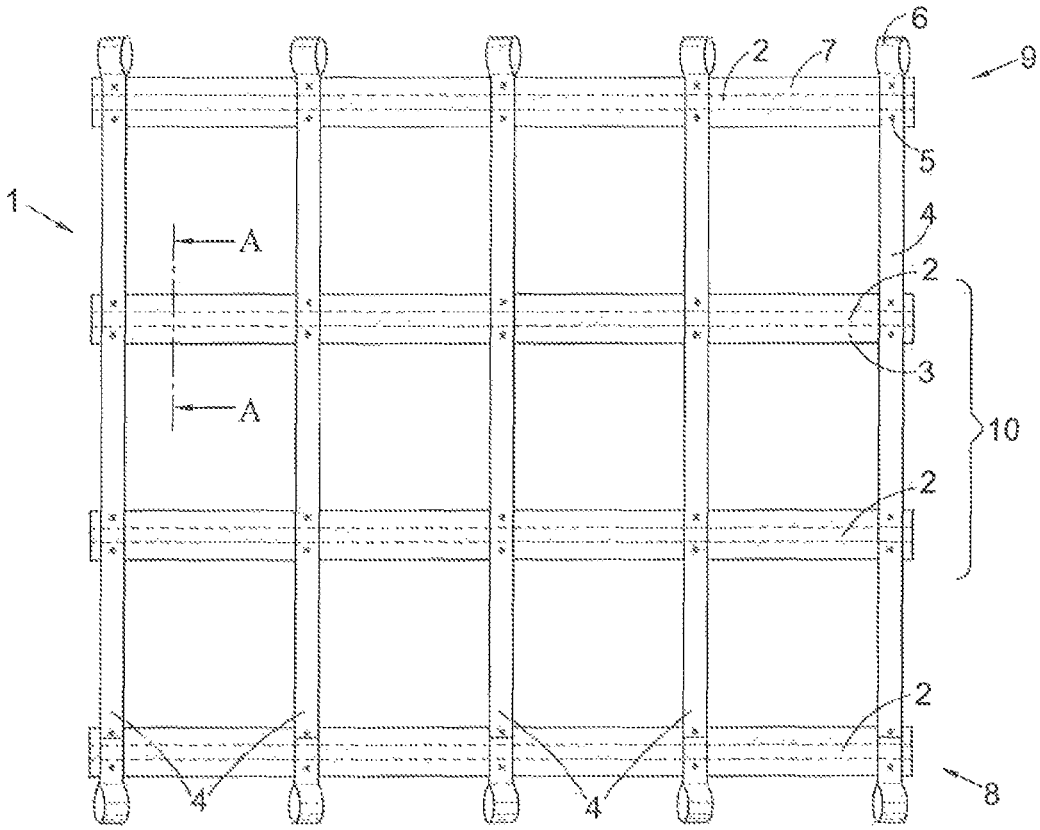
FIG. 1 shows a plan view of one embodiment of a rescue device in accordance with the invention when the device is laid out flat.
Figure 2:
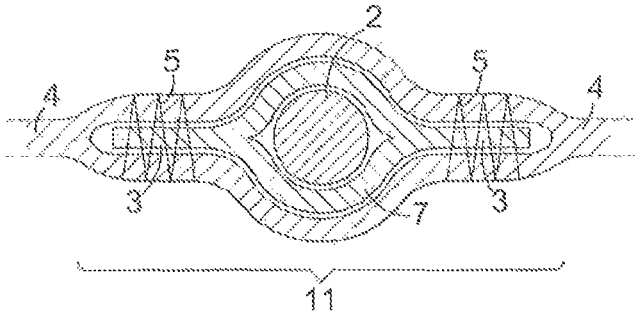
FIG. 2 shows a cross-sectional view across the line A-A of FIG. 1.
Figure 4:
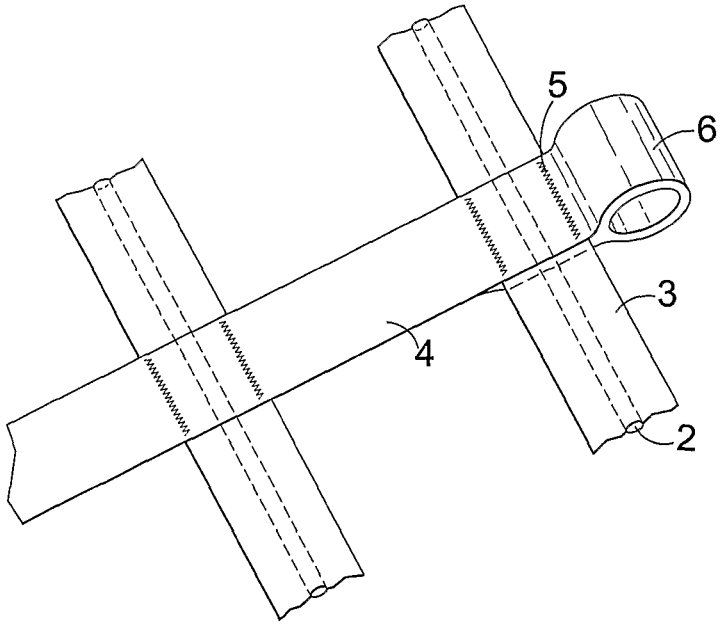
FIG. 4 shows an enlarged view of a section of the embodiment of FIG. 1.

In a first embodiment of the present invention, as exemplified in FIG. 1, there is provided a rescue device 1 to aid in the recovery and rescue of a person from the water. The device 1 comprises a number of (e.g. four) horizontal glass fibre rods, each encased within a flexible sheath 7 of tubular polyester construction. Alternatively, the rods 2 are made from a composite material, metal or a fibre, such as carbon fibre. Each flexible sheath 7 has two flanges 3 opposite each other as shown in FIG. 2 and thus forms horizontal webbing. The flanges 3 extend radially outwards away from the rod 2 by 2 cm although distances between 1 cm and 8 cm would also be suitable. The rods 2 are arranged in parallel and they are connected together by a number of (e.g. five) vertical lengths of webbing which are also made from woven polyester or other synthetic fibre. As shown in FIG. 4 the webbing elements 4 are at right angles to the rods 2 and are secured to the flanges 3 of the horizontal webbing encasing the rods 2 by sewing 5 or by welding. The width of the horizontal webbing is preferably similar to the width of the webbing elements 4. The horizontal webbing and webbing elements 4 are both uniformly spaced so the device 1 comprises a grid of rods encased in horizontal webbing and vertical linking webbing. The rods 2 are spaced apart by 30 cm and the webbing elements 4 are also spaced apart from each other by 30 cm to form a square. The whole rescue device 1 is approximately 1.2 m wide (the length of the rods 2)×3 m long (the length of the webbing elements 4). The width and length of the device can be adjusted as necessary, e.g. the width can be as small as 60 cm.

The horizontal rod at one end of the rescue device 1 is for attachment to a vessel and defines the inboard end 8 of the rescue device 1. The horizontal rod at the other end of the rescue device 1 defines the outboard end 9 of the rescue device 1. At either or both the inboard and outboard ends 8, 9 of the device 1 there are flexible loops 6 extending from the webbing elements 4.

It is to be appreciated that in the embodiment shown in FIG. 1 the horizontal rods are secured at right angles to the webbing elements 4 without the need for metal components. Furthermore, the polyester weave from which the flexible sheath 7 and the webbing elements 4 are made is resistant to photo-degradation and sea water.

In preferred embodiments of the present invention, at each section where it joins the horizontal webbing the webbing element 4 bifurcates and rejoins in order to form a pocket 11 into which the rod 2 encased in the flexible sheath 7 is inserted and secured by sewing, as exemplified in FIG. 2. It is particularly preferred that the webbing 4 is a double thickness woven material and the pockets are formed by two single thickness sections of the material, which lie on either side of the flexible sheath 7.

In preferred embodiments the sewing 5 that secures the flexible sheath 7 and the webbing element 4 comprises continuous stitching along the length of the flange 3, parallel to the rod 2. In alternative embodiments the flexible sheath 7 and the webbing element 4 are secured by zig-zag stitching that spans the depth of the flange 3, but continuous stitching is generally more practical.

In alternative embodiments of the present invention, the width and length of the device 1 is varied depending on the size of the rescue vessel. Furthermore, the number of rods 2 and webbing elements 4 that the device 1 comprises may be varied.

In some embodiments of the present invention, the rescue device additionally comprises a number of the horizontal webbing elements that are of plain construction (i.e. flat) rather than being tubular with flanges 3 and containing rods 2. The purpose of the plain webbing rungs is to increase the support of the cradle without adding bulk and weight.

In further embodiments the length of the device 1 can vary from 1 m to 20 m. In still further embodiments the rods are spaced between 15 cm to 60 cm apart and the webbing elements 4 is spaced between 15 cm and 60 cm from each other.

In a further embodiment of the present invention, there are floatation devices attached to the outboard end 9, or both the inboard and outboard ends 8, 9, of the device 1 to prevent the ends 8, 9 from sinking in the water, or to hold the inboard end away from the sides of the rescue vessel.

In use, the rescue device 1 of the present invention is secured by a rod 2 at the inboard end 8 of the device 1 to a rescue vessel (not shown). A rope or bridle is attached to the loops of the outboard end 9 and the middle section 10 of the device 1, between the inner and outboard ends 8, 9, is lowered into the water a short distance away from the vessel. The middle section 10 of the device 1 sinks in the water, enabling a person who may be exhausted or injured to manoeuvre themselves, or a person who may be unconscious to be guided, onto the device 1, substantially parallel to the rods 2. The device could also be manoeuvred under the body of the casualty. The outboard end 9 of the device 1 is then retrieved and pulled upwards and towards the vessel using the rope, so rolling or "parbuckling" the person lying on the device 1 onto the vessel. The size of the device 1 is adjusted to be suitable for the size vessel it is used on.

In an alternative embodiment of the invention, the rescue device 1 is used as a scramble net. The inboard end 8 of the device 1 is secured to the vessel and the rest of the device 1 is lowered over the side of the vessel, allowing multiple people to climb up or down the net simultaneously using the rods 2 as the rungs of a ladder. The device 1 is particularly suitable for climbing because the rods 2 give firm footholds, making it easier to ascend or descend.

Figure 3:
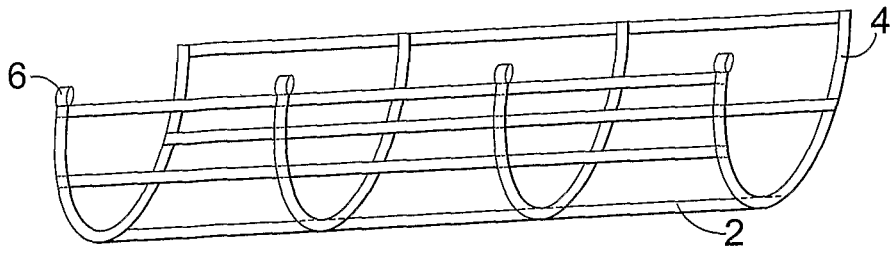
FIG. 3 shows a perspective view of the embodiment of FIG. 1 in a cradle shape.

In a further embodiment of the present invention exemplified in FIG. 3, the rescue device 1 is completely detached from the vessel and used as a stretcher or cradle to carry an injured or exhausted person.

In one variation of this embodiment the rods 2 are spaced at 15 cm intervals, but alternatively the rods 2 can be positioned at intervals ranging from 10 cm to 60 cm. The device also comprises additional flexible webbing strips parallel to the rigid rods 2. The close spacing of the rods 2 together with the additional flexible webbing strips gives the cradle 1*a* substantially solid surface area. This is advantageous when using the device as a cradle because the filled in surface area provides more support and greater comfort for the exhausted or injured person being carried in the cradle. In a further aspect of this embodiment handles or loops 6 are provided that are connected to the rods 2 of the device 1. In use the outermost rigid rods 8, 9 of the cradle 1 are fastened together to contain the body.

In an alternative embodiment the rescue device 1 is used in air-sea rescue and is lowered into the sea from a rescue helicopter. In this embodiment the rods 2 at the inboard and outboard ends 8, 9 of the device 1 are secured to a line that is attached to the helicopter. The person to be rescued lies horizontally on the device 1, parallel to the horizontal rods, and the device 1 folds around the person into a cradle shape as the device 1 is lifted out of the water.

In an alternative embodiment of the invention the rescue device 1 is used when climbing, caving or working at height on a construction or building site, high above the ground. In a situation where a person has fallen from a height and is suspended in the air wearing a safety harness, there is a danger of suspension trauma, which can cause permanent injury and death. The rescue device 1 is lowered to enable the suspended person to lie horizontally and restore blood flow to the brain.

Figure 5:
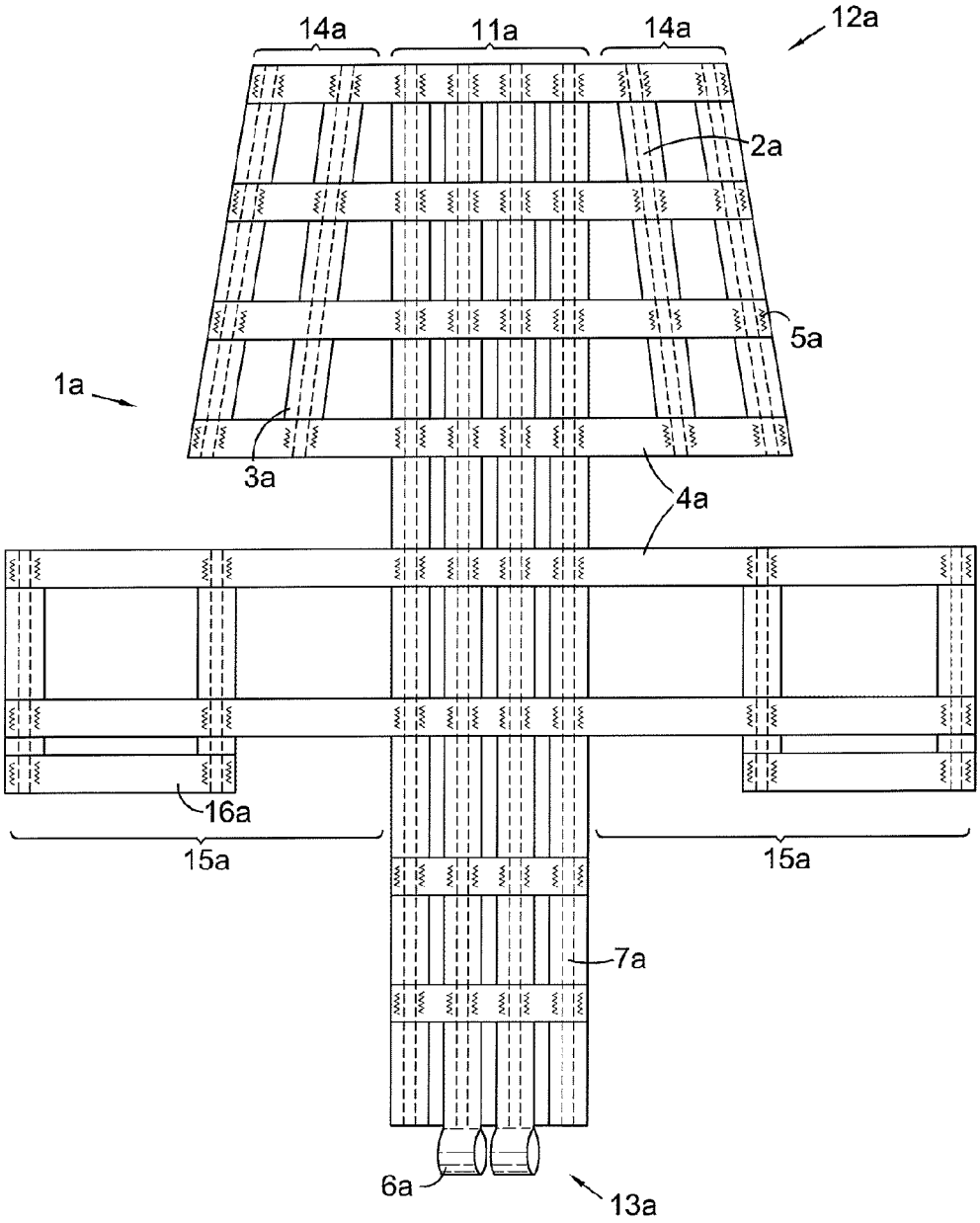
FIG. 5 shows a plan view of an alternative embodiment of the invention, which is suitable for use as a stretcher.

In a still further embodiment of the present invention shown in FIG. 5, the device 1*a* is modified for use as a stretcher. There is provided a series of rigid rods 2*a* each encased in a flexible sheath 7*a* with two flanges 3*a* extending radially from each rigid rod 2*a*. As in the previous embodiments, the rigid rods 2*a* are connected to linking webbing elements 4*a* by sewing or welding the linking webbing elements 4*a* to the flanges 3*a* of the tubular webbing encasing the rigid rods 2*a*. There is a core area 11*a* where four rigid rods 2*a* are arranged in parallel every 30 cm. Alternatively, the core area can comprise between two and eight rigid rods 2*a* spaced at intervals ranging from every 15 cm to every 60 cm. The rods in the core area 11*a* are of a uniform length of 2 m, but the length can range between 1.2 m and 2.5 m.

At a first end 12*a* of the stretcher, there are panels 14*a* comprising further rigid rods 2*a* that are arranged symmetrically on either side of the core area 11*a*. Each rigid rod 2*a* in the panel 14*a* is encased within a sheath of tubular flexible material, and each flexible sheath 7*a* has two flanges 3*a* extending radially outwards from the rigid rod 2*a*. The additional panels 14*a* each comprise two rigid rods 2*a* that are spaced at 20 cm intervals. Alternatively, the panels 14*a* can comprise up to five rigid rods 2*a* and the spacing can range from 15 cm to 60 cm. The rigid rods 2*a* are attached to the core area 11*a* by the continuous linking webbing elements 4*a* which extend from the core area 11*a*. The linking webbing elements 4*a* within the panels 14*a* are of plain construction (i.e. flat) and do not bifurcate either side of the flexible sheath 7*a* and rigid rods 2*a*. The linking webbing elements 4*a* are secured to the flanges 3*a* of the tubular webbing encasing the rods 2*a* by sewing or welding. The length of the rigid rods 2*a* in the panels 14*a* is 0.75 m, but can alternatively be between 0.5 m and 1 m. The rigid rods 2*a* in the panels 14*a* are not in parallel with the rigid rods 2*a* of the core area 11*a*.

At approximately the mid-point of the stretcher there is an additional mid-panel 15*a* of rigid rods 2*a* on either side of the core area 11*a*. The mid-panels 15*a* comprise two rigid rods 2*a*, and the rods are spaced at 30 cm intervals. Alternatively, the mid-panels 15*a* can comprise between two to five rigid rods 2*a* and the spacing can be between 15 cm to 60 cm. Each rigid rod 2*a* in the mid-panel 15*a* is encased within a sheath 7*a* of tubular flexible material, and each flexible sheath 7*a* has two flanges 3*a* extending radially outwards from the rigid rod 2*a*. The rigid rods 2*a* of the mid-panel 15*a* are attached to the core area 11*a* by the continuous linking webbing elements 4*a* in the same way as described for the lower panels 14*a*. The length of the rigid rods 2*a* in the mid-panel 15*a* is 0.5 m, but alternatively can range from 25 cm to 1 m. The rigid rods 2*a* of the mid-panel 15*a* are arranged in parallel with the rigid rods 2*a* of the core area 11*a* and they are longer than the distance between adjacent linking webbing elements 4*a*. Therefore, one end of the rigid rods 2*a* in the mid-panel are not connected to the core area 11*a* by a linking webbing element 4*a*. Instead, an additional linking webbing element 16*a* connects the rigid rods 2*a* within the mid-panel 15*a* together but it does not extend towards the core area 11*a*. Loops 6*a* are provided at the second end 13*a* of the stretcher. The loops 6*a* are continuous from the flexible sheath 7*a* surrounding the rigid rods 2*a* in the core area 11*a*.

Preferably, there are quick release buckles and straps present on both sets of panels 14*a*, 15*a* to enable a person to be secured into the stretcher (not shown in FIG. 5), and there are loops 6*a* at the first end 12*a* of the stretcher. The loops 6*a* are continuous from the flexible sheath 7*a* of the tubular webbing surrounding the rigid rods 2*a* in the core area 11*a*. Additionally, there is provided a strap of flexible material that runs parallel to the linking webbing elements 4*a* of the stretcher. The strap is positioned at approximately the mid-point of the stretcher, behind the mid-panels 15*a*.

In use, a person is positioned on the stretcher so that their feet are at the first end 12*a* of the stretcher and their head is at the second end 13*a*. The panels 14*a*, 15*a* are wrapped one over the other in order to secure the person on the stretcher. The angle of the rigid rods 2*a* in the panels 14*a* at the first end 12*a* of the stretcher in relation to the rigid rods 2*a* of the core section 11*a* is such that the panels 14*a* taper in towards the first end 12*a* of the stretcher. The shape of the mid-panels 15*a* enables them to be fastened under the arms of the casualty and secured around their torso. If the casualty is unconscious then the additional strap is used to secure their arms by their sides. The loops 6*a* at the second end 13*a* of the stretcher enable the stretcher to be lifted vertically when a person is strapped into the stretcher. The loops 6*a* at the first end 12*a* of the stretcher can be connected to ropes that are used to guide and stabilise the stretcher whilst it is lifted. Alternatively, the loops 6*a* are used as mounting points for foot stirrups. The fact that the panels 14*a* are tapered results in the stretcher being secured more tightly at the first end 12*a* around a person's feet, and so prevents the person from slipping downwards in the stretcher when it is lifted vertically by the loops 6*a* at the second end 13*a*. This feature, and the fact that the mid-panels 15*a* are wrapped around the torso of the casualty, enables the casualty to be fastened securely in the stretcher. This is particularly important if the casualty has a spinal injury.

Figure 6:
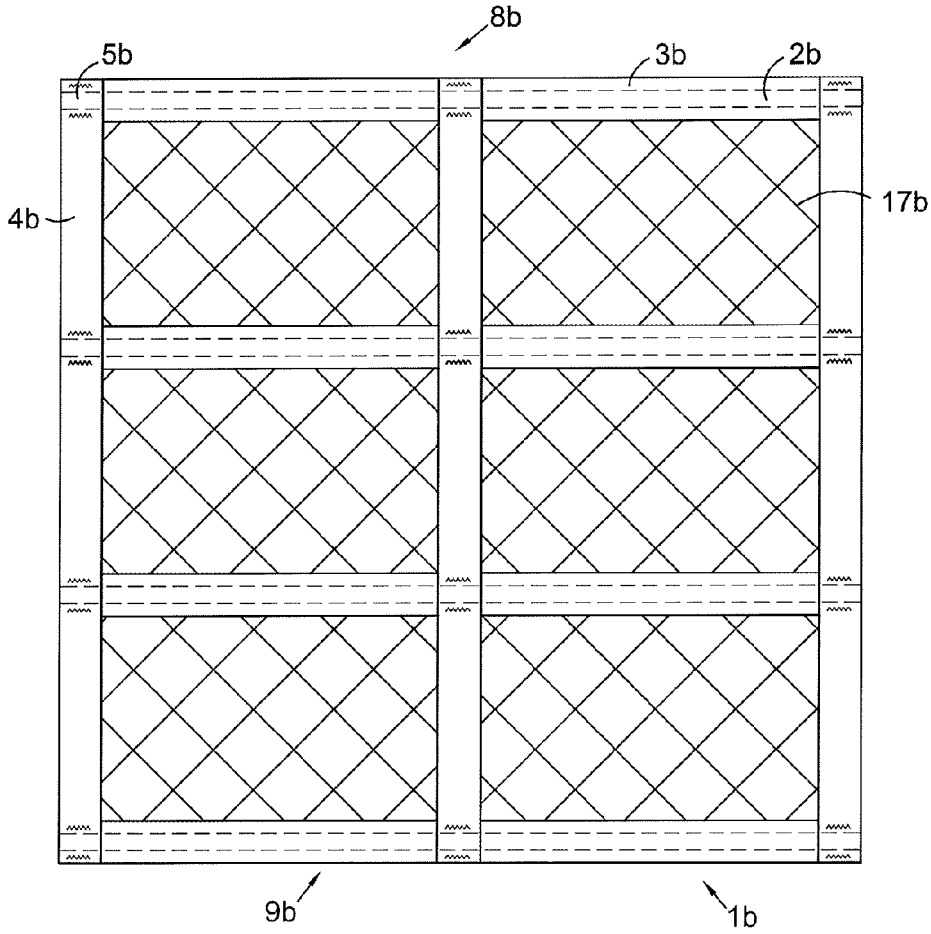
FIG. 6 shows a plan view of an alternative embodiment of the invention, which is suitable for use in recovering corpses from water.

In a still further embodiment of the invention shown in FIG. 6 there is provided a device 1*b* for removing a corpse or debris from the water. There are provided four or more rigid rods 2*b*, at least two of which are situated at either end 8*b*, 9*b* of the device. The rigid rods 2*b* are arranged in parallel and are encased in a flexible sheath 5*b* with at least one radially extending flange 3*b*. Also provided are two or more strips of flexible linking webbing 4*b*, which are attached to the flanges 3*b* of the tubular webbing 5*b* encasing the rigid rods 2*b* by means of sewing or welding as shown in FIG. 2. The flexible linking webbing 4*b* is arranged perpendicular to the rigid rods 2*b*. A linking webbing element 4*b* is attached to each end of the rigid rods 2*b*, so as to form a rectangle or square network network of rigid rods 2*b* and linking webbing elements 4*b*. The dimensions of the device are 2 m×3 m, but the device can be any size between 1 m×1 m to 4 m×4 m. A sheet of fabric mesh 17*b* is attached to the flanges 3*b* of the tubular material encasing the outermost rigid rods 2*b* and the linking webbing elements 4*b* to enable to device to act as a net. The mesh fabric allows water to pass through it easily so the device does not become waterlogged after it has been submerged beneath the water.

In a variation of this embodiment, extra linking webbing elements 4*b* are connected between the rigid rods 2*b*, in parallel to the outermost linking webbing elements 4*b*. Also, further linking webbing elements 4*b* can be connected between the outermost linking webbing elements 4*b*, parallel to the rigid rods 2*b*.

In use the device 1*b* described in this embodiment is suitable for recovering and containing a body until the time-point at which the body is disposed. It comprises a minimal number of rigid rods 2*b* which lowers the overall cost of the device. The device can be disposable.

Figure 7:
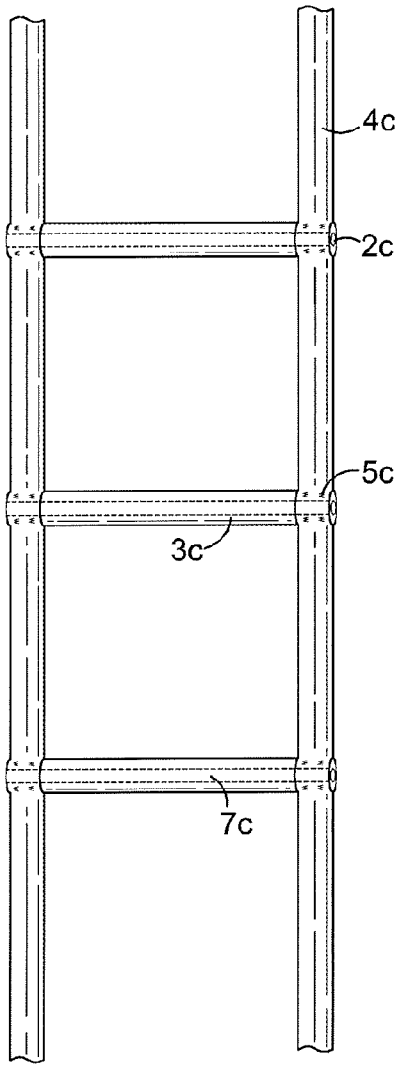
FIG. 7 shows a plan view of a further alternative embodiment of the invention, which is suitable for use as a ladder.

In a still further embodiment as shown in FIG. 7 there is provided a device that is an improvement on the 'Fibrelight Ladder' described in WO-A-99/66165. In this embodiment the rigid rods 2*c* of the ladder are encased in a flexible sheath 7*c* with radially extending flanges 3*c*. The rigid rods are 20 cm in length, although lengths of between 15 cm and 30 cm are also suitable. The flanges 3*c* are 2.5 mm to 2 cm wide, preferably 5 mm wide. Either end of the rigid rod 2*c* is attached to a linking webbing element 4*c* so there are two linking webbing elements 4*c* in total. The rigid rod 2*c* and flexible sheath 7*c* is attached to the linking webbing element 4. At the point where the flexible sheaths 7*c* are attached, the linking webbing elements 4*c* bifurcates and rejoins in order to form a pocket into which the rigid rod 2*c* encased in the tubular sheath 7*c* is inserted and secured by sewing. The linking webbing elements 4*c* are spaced at intervals ranging from every 15 cm to 60 cm, preferably every 30 cm. The rigid rods 2*c* are uniformly spaced at 15 cm to 60 cm intervals, preferably at 30 cm intervals, along the linking webbing elements 4*c*. In alter-native embodiments floatation devices are attached to the ladder.

In a preferred version of this embodiment, the flexible sheaths 7*c* extend beyond the ends of the rigid rod 2*c*. These ends of the flexible sheaths 7*c* are folded back on themselves and secured into the pocket of the linking webbing elements 4*c* by sewing. The purpose of this is to prevent to rigid rods 2 from moving within the flexible sheaths 7*c*.

In use, this embodiment of the device of the present invention can be climbed like a rope ladder. Because the weight of an individual climbing the ladder is distributed, through each rigid rod 2*c*, across the entire width of the linking webbing elements 4*c*, strain and wear on the material from which the flexible sheaths 7*c* and the linking webbing elements 4*c* is made is minimised.

In an alternative version of this embodiment, there is provided a device wherein the length of the rigid rod 2*c* is increased to 30 cm, although lengths of between 25 cm to 60 cm are also suitable. The purpose of the extended length of the rigid rod 2*c* is to enable the ladder to be climbed more quickly by multiple persons. The extra weight of the second person is supported by increasing the diameter of the rigid rod 2*c*. In a further version of this embodiment, there is provided an additional linking webbing element 4*c* attached to the rigid rods 2*c*. The additional linking webbing element 4*c* is positioned parallel to the linking webbing elements 4*c*, preferably halfway between the outermost linking webbing elements 4*c*.

In a still further version, there is provided a device comprising three linking webbing elements 4*c* and a plurality of rigid rods 2*c* that bridge two out of the three linking webbing elements 4*c*. The rigid rods are 20 cm long, although lengths of between 15 cm to 30 cm are also suitable. The rigid rods 2*c* are spaced at 20 cm intervals on alternating sides of the middle linking webbing element 4*c*, although intervals of 15 cm to 30 cm are also suitable.

In the above-described embodiments, the rods 2 are cylindrical having a diameter of 15 mm. However, in alternative embodiments the rods 2 are made from carbon fibre and are 10 mm in diameter, resulting in the device 1 being lighter. In further embodiments, the diameter of the rods 2 is between 5 mm and 25 mm, preferably between 8 mm and 15 mm. In still further embodiments, different rods 2 are made from different materials. In alternative embodiments, the rods 2 are all made from the same material and weights are provided at the mid point to cause the middle section 10 of the device 1, between the inboard and outboard ends 8, 9, to sink and so create a cradle.

The rods 2 may be hollow or solid and of circular, oval or other cross-section.

The invention claimed is:

1. A device comprising:

a plurality of rods each rod being encased within a sheath made from a flexible webbing strip, the webbing strip comprising a flexible tubular webbing that encases the rod and at least one flange extending radially outwardly from the tubular webbing; and a plurality of linking webbing elements made from a flexible webbing material, the linking webbing elements linking at least two of the sheaths to form a network of rods encased within tubular webbing sheaths and linking webbing elements;

wherein:

the linking webbing elements are attached to a respective sheath by being attached to the at least one flange of the flexible webbing strip of that sheath;

the rods are of any cross-sectional shape;

at least one of the linking webbing elements is formed from a double thickness material and comprises pockets at predetermined intervals, each rod being located within a pocket, wherein each pocket is formed by two single thickness sections of the double thickness material, with the two single thickness sections lying on either side of the rod and sheath located therein, and wherein the at least one flange of the sheath, but not the tubular webbing part of the sheath is attached to the two single thickness sections of the respective pocket of the linking webbing element lying either side thereof.

2. The device according to claim 1, wherein the rods are made from a material selected from a group consisting of: glass fiber, a composite material, metal, and carbon fiber.

3. The device according to claim 1, wherein the rods have lengths, and the length of at least one of the rods is selected from the group consisting of: at least 15 cm, at least 30 cm, at least 60 cm, at least 100 cm, and at least 120 cm long.

4. The device according to claim 1, wherein the linking webbing elements span a distance of between 1 m to 20 m.

5. The device according to claim 1, wherein at least one of rods is a rigid rod having a diameter and the diameter of said rigid rod is selected from the group consisting of: 5 mm and 25 mm.

6. The device according to claim 1, wherein the webbing of the sheath or the webbing of the linking webbing elements is a synthetic fibre, selected from the group consisting of: polyester and woven polyester.

7. The device according to claim 1, wherein the flexible webbing strip has a width, the width being between 2.5 mm and 8 cm.

8. The device according to claim 1, wherein the sheath comprises two flanges extending radially outwardly from the rod.

9. The device according to claim 1, wherein the linking webbing elements are attached to the flange of the sheath by at least one of sewing and welding.

10. The device according to claim 1, wherein the rods are arranged in parallel.

11. The device according to claim 1, wherein at least one of the linking webbing elements comprises a loop at at least one end.

12. The device according to claim 1, further comprising additional flexible webbing rungs parallel to the rods.

13. The device according to claim 1, wherein the plurality of the rods and the plurality of the linking webbing elements comprise a core of the device, and wherein the device further comprises additional panels on one or more sides of the core, the panels comprising a network of rods encased within tubular webbing sheaths and linking webbing elements.

14. The device according to claim 1, wherein the device is a rescue cradle.

15. The device according to claim 1, wherein the device is a scramble net.

16. The device according to claim 1, wherein the device is a ladder.

17. A vessel comprising a device according to claim 1.

18. The device according to claim 1, wherein the rods are spaced between 15 cm and 60 cm apart.

19. The device according to claim 1, wherein the sheaths are secured to the linking webbing elements without metal components.

20. The device according to claim 1, wherein the pockets comprise at least one elongate region extending parallel to the linking webbing elements and the at least one flange of the tubular webbing in each pocket is located in the at least one elongate region.

21. A device comprising:

a plurality of rods each rod being encased within a sheath made from flexible webbing, the flexible webbing forming the sheath that encases the rod and two flanges extending radially outwardly from the sheath; and a plurality of linking webbing elements made from a flexible webbing material, the linking webbing elements linking at least two of the sheaths to form a network of rods encased within sheaths and linking webbing elements;

wherein:

the linking webbing elements are attached to a respective sheath by being attached to the flanges of the webbing that forms that sheath;

the rods are of any cross-sectional shape;

at least one of the linking webbing elements is formed from a double thickness material and comprises pockets at predetermined intervals, each rod being located within a pocket, wherein each pocket is formed by two single thickness sections of the double thickness material, with the two single thickness sections lying on either side of the rod and sheath located therein, and wherein the flanges of the webbing that forms that sheath, but not the directly the sheath part of that webbing, is attached to the two single thickness sections of the respective pocket of the linking webbing element lying either side thereof.

* * * * *